US006186854B1

(12) United States Patent
Lai

(10) Patent No.: US 6,186,854 B1
(45) Date of Patent: Feb. 13, 2001

(54) ASSEMBLING STRUCTURE FOR TAIL WING OF A MODEL AIRPLANE

(75) Inventor: Aling Lai, Taichung (TW)

(73) Assignee: Thunder Tiger Corporation, Taichung (TW)

( * ) Notice: Under 35 U.S.C. 154(b), the term of this patent shall be extended for 0 days.

(21) Appl. No.: 09/395,342

(22) Filed: Sep. 13, 1999

(51) Int. Cl.[7] ..... A63H 27/00
(52) U.S. Cl. ..... 446/34; 446/88
(58) Field of Search ..... 446/34, 30, 33, 446/61, 63, 66, 87, 88

(56) References Cited

U.S. PATENT DOCUMENTS 2,281,792 * 5/1942 Ott ..... 446/34
2,303,632 * 12/1942 Grant ..... 446/34
4,270,301 * 6/1981 Meek ..... 446/88
5,035,382 * 7/1991 Lissaman et al. ..... 446/34 X
5,064,145 * 11/1991 Wagener ..... 446/34 X

* cited by examiner

*Primary Examiner*—D. Neal Muir
(74) *Attorney, Agent, or Firm*—Rosenberg, Klein & Lee

(57) ABSTRACT

An assembling structure for tail wing of a model airplane. The airplane body has a horizontal connecting face at tail section for connecting with the horizontal tail wing and vertical tail fin. A bottom face of the vertical tail fin is disposed with two projecting fixing rods. A center of the horizontal tail wing is formed with two through holes corresponding to the fixing rods of the tail fin. A sleeve is fitted on inner wall of each through hole. The connecting face of the tail of the airplane body is also formed with two through holes corresponding to the fixing rods of the tail fin. A sleeve is fitted on inner wall of each through hole. The fixing rods of the tail fin can be firmly passed through the tail wing and airplane body and locked by screws. Therefore, the tail wing of the model airplane can be quickly firmly assembled or disassembled from the airplane body for easy carriage or storage.

3 Claims, 4 Drawing Sheets

ASSEMBLING STRUCTURE FOR TAIL WING OF A MODEL AIRPLANE

BACKGROUND OF THE INVENTION

The present invention relates to an assembling structure for tail wing of a model airplane, which permits the tail wing to be quickly firmly assembled or disassembled from the airplane body for easy carnage or storage.

FIG. 4 shows a conventional assembling structure for tail wing of a model airplane. The airplane body 80 has a horizontal connecting face 81 at tail section and the bottom of the vertical tail fin 82 is formed with a notch 821. An engaging block 822 is adhered to the notch 821 for inserting a U-shaped fixing thread rod 83 at the bottom of the tail fin 82. The horizontal tail wing 84 and the connecting face 81 of the airplane body 80 are formed with through holes 841, 811 corresponding to the U-shaped thread rod 83. Therefore, the U-shaped thread rod 83 can be passed through the tail wing 84 and the connecting face 81 of the airplane body 80 and locked by a nut 85 and a washer 86 from the bottom face of the airplane body 80 so as to fix and assemble the airplane body 80, vertical tail fin 82 and horizontal tail wing 84.

The model airplane is made of light wood material with low density and is relatively soft. The tail fin 82 and the tail wing 84 serve to control the left and right turning and ascending and descending of the entire airplane and stabilize the flight. The tail fin 82 and the tail wing 84 will bear considerably great external force in flying. Therefore, under the continuous pressure of external force, the hard U-shaped thread rod 83 will expand the soft hole walls of the holes 841, 811. Under such circumstance, the tail fin 82 and the tail wing 84 can be hardly firmly fixed. This will affect the stability in flight of the model airplane or even lose control of the model airplane.

When adhering the front and rear connecting faces of the engaging block 822 to the notch 821 of the bottom of the tail fin 82, it is necessary at the same time insert the U-shaped thread rod 83. Moreover, the left and right sides of the engaging block 822 are only covered by the skin 823 of the tail fin 82 so that the adhesion area of the engaging block 822 to the notch 821 is reduced. After continuously suffering considerably great external force, the tail fin 82 may be loosened from the engaging block 822 to affect the safety of the model airplane in flying or even lead to crash of the model airplane.

SUMMARY OF THE INVENTION

It is therefore a primary object of the present invention to provide an assembling structure for tail wing of a model airplane. The bottom face of the vertical tail fin is disposed with two projecting fixing rods. The horizontal tail wing and the connecting face of the tail of the airplane body are formed with through holes corresponding to the fixing rods of the tail fin. A sleeve is fitted on inner wall of each through hole. The fixing rods of the tail fin can be firmly passed through the tail wing and airplane body and locked by screws. Therefore, the tail wing of the model airplane can be quickly firmly assembled or disassembled from the airplane body for easy carriage or storage.

According to the above object, in the assembling structure for tail wing of a model airplane of the present invention, the airplane body has a horizontal connecting face at tail section for connecting with the horizontal tail wing and vertical tail fin.

A bottom face of the vertical tail fin is formed with two rectangular sockets for the rectangular sections of two fixing rods to insert therein. An upper section of the fixing rod is a rectangular section. A lower section of the fixing rod is a cylindrical section. A bottom end of the fixing rod is formed with an axial hole. A screw fitted with a washer is screwed and tightened from the bottom face of the airplane body in the hole.

A center of the horizontal tail wing is formed with two through holes corresponding to the fixing rods of the tail fin. A sleeve is fitted on inner wall of each through hole.

The connecting face of the tail of the airplane body is formed with two through holes corresponding to the fixing rods of the tail fin. A sleeve is fitted on inner wall of each through hole.

The present invention can be best understood through the following description and accompanying drawings wherein:

DETAILED DESCRIPTION OF THE PREFERRED EMBODIMENT

Figure 1:
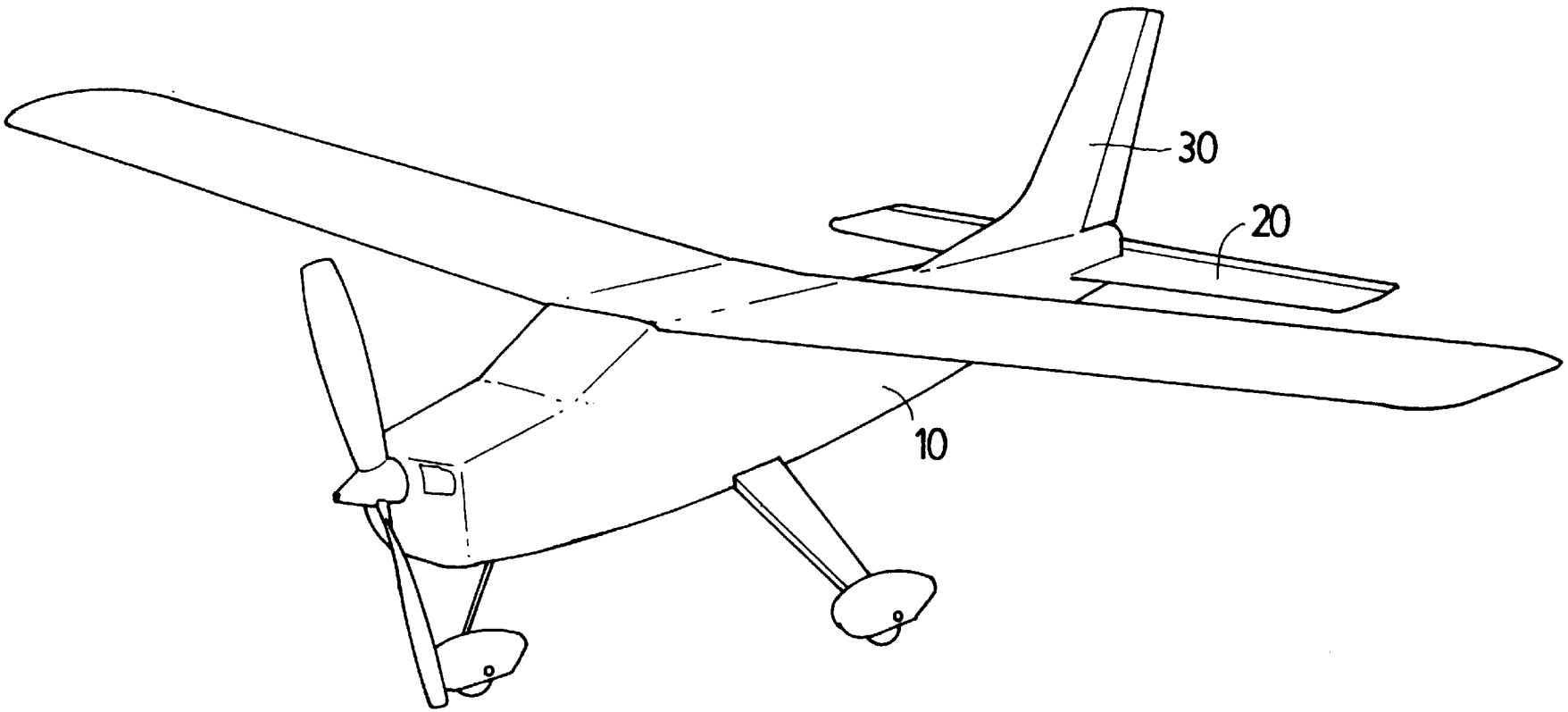
FIG. 1 is a perspective view showing the appearance of the present invention.
Figure 2:
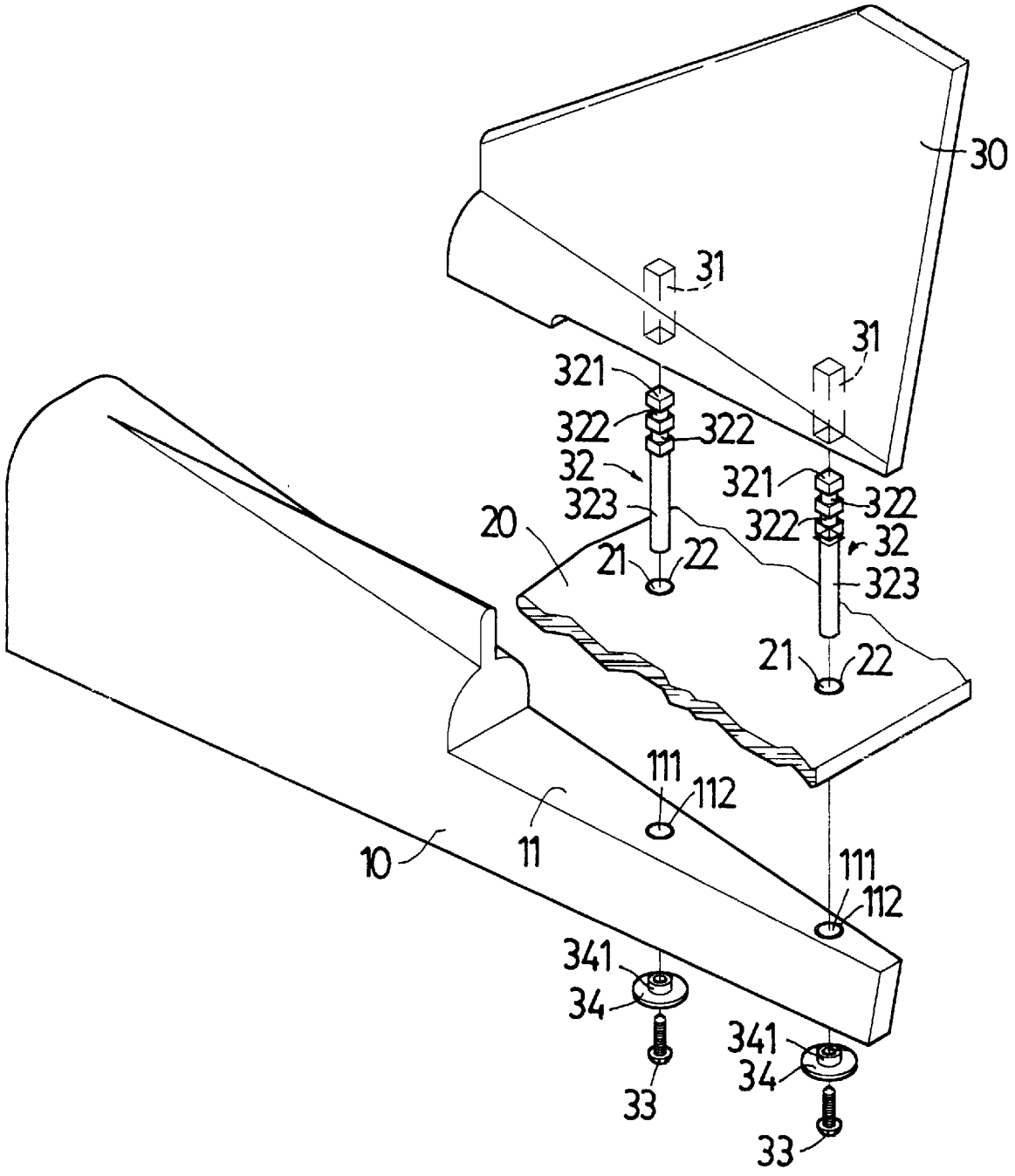
FIG. 2 is a perspective exploded view of the airplane body, horizontal tail wing and vertical tail fin of the present invention.
Figure 3:
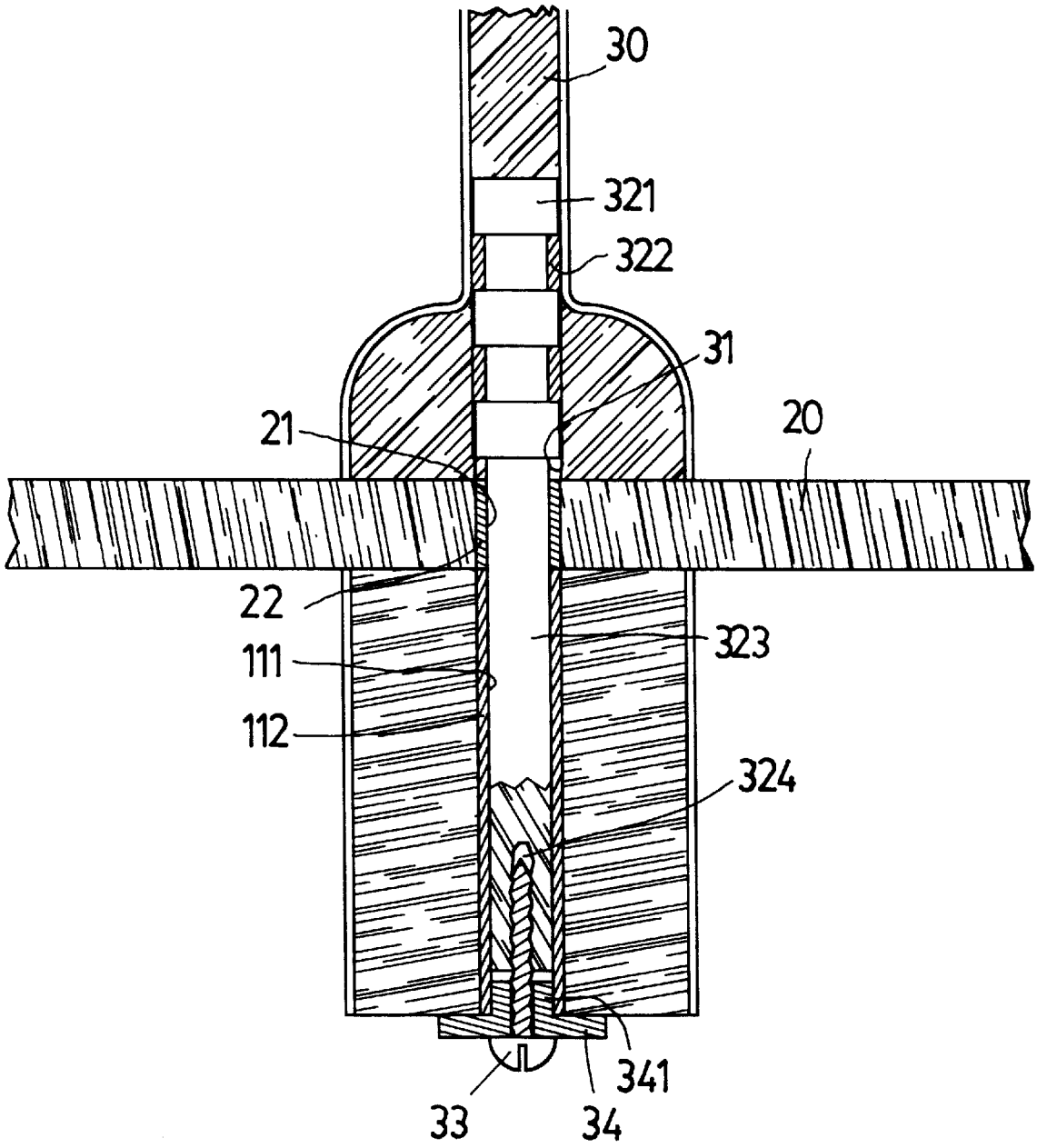
FIG. 3 is a sectional assembled view of the airplane body, horizontal tail wing and vertical tail fin of the present invention.
Figure 4:
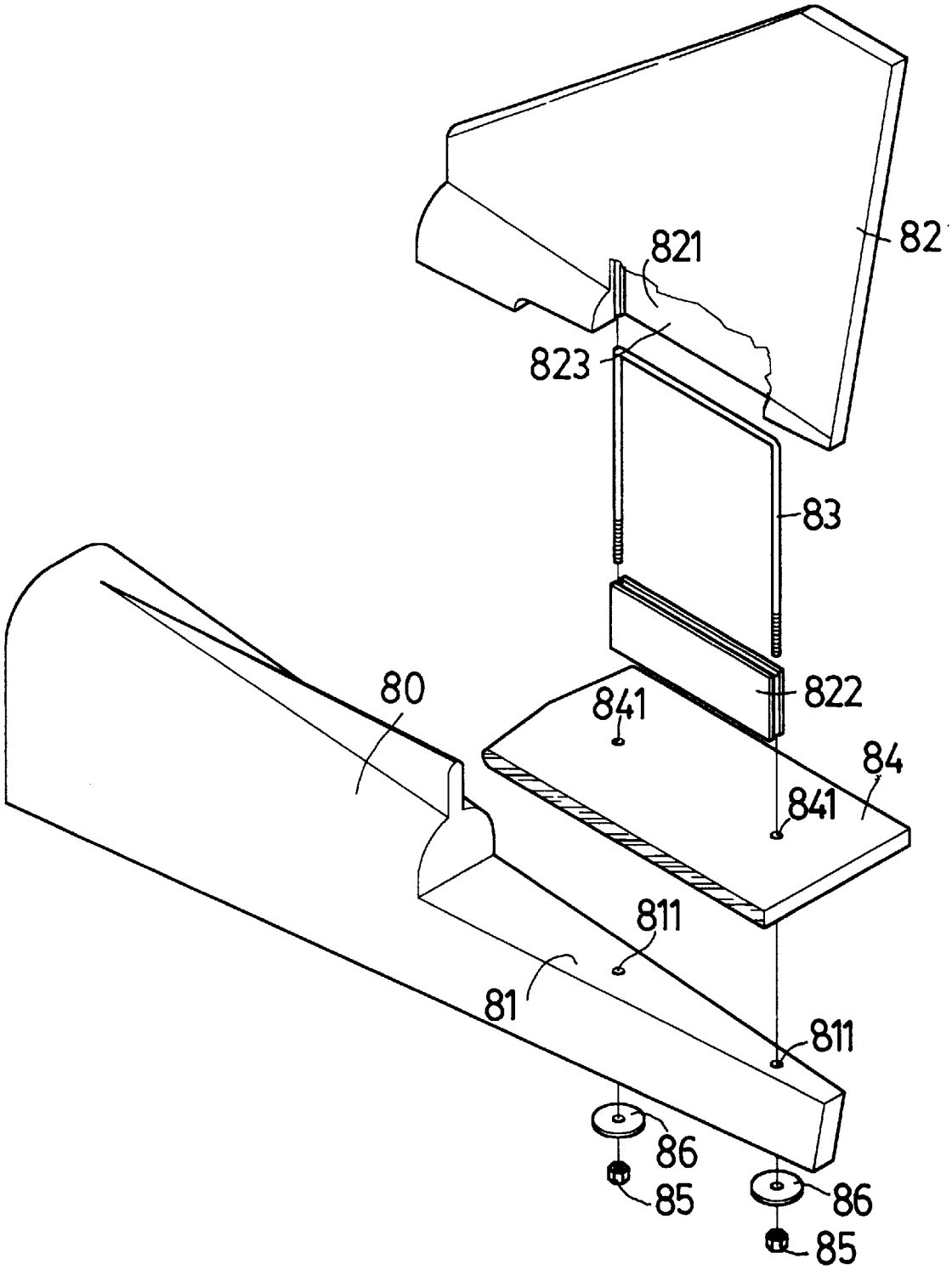
PRIOR ART FIG. 4
FIG. 4 is a perspective exploded view of the tail wing of a conventional model airplane.

Please refer to FIGS. 1 to 3. The airplane body 10 of the present invention has a horizontal connecting face 11 at tail section for connecting with the horizontal tail wing 20 and vertical tail fin 30.

The bottom face of the vertical tall fin 30 is formed with two rectangular sockets 31 for the rectangular sections 321 of two fixing rods 32 to insert therein. The upper section of the fixing rod 32 is a rectangular section 321 formed with multiple annular grooves 322. The lower section of the fixing rod 32 is a cylindrical section 323. The bottom end of the fixing rod 32 is formed with an axial hole 324. A screw 33 fitted with a washer 34 can be screwed and tightened from the bottom face of the airplane body 10 in the hole 324. The washer 34 has an axial collar section 341.

The center of the horizontal tail wing 20 is formed with two through holes 21 corresponding to the fixing rods 32 of the tail fin 30. A sleeve 22 is fitted on inner wall of each through hole 21.

The connecting face 11 of the tail of the airplane body IO is formed with two through holes 111 corresponding to the fixing rods 32 of the tail fin 30. A sleeve 112 is fitted on inner wall of each through hole 111.

The sleeves 112, 22 are made of plastic material and will not be expanded. Therefore, when the cylindrical section 323 of the fixing rod 32 of the tail fin 30 is passed through the through hole 21 of the tail wing 20 and the through hole 111 of the mating face 11 of the tail of the airplane body 10, the cylindrical section 323 is restricted by the sleeves 112, 22 to firmly fix the tail wing 20 and the airplane body 10. Therefore, the tail fin 30, tail wing 20 and the airplane body 10 are kept containing fixed angles so as to maintain operability and stability of the model airplane in flying.

The rectangular section 321 of the fixing rod 32 is inserted and fixed in the rectangular socket 31 of the tail fin 30. In addition, a glue can be painted in the annular grooves 322 to enhance the adhesion. Therefore, the fixing rod 32 can be firmly fixed with the tail fin 30 without rotation. In addition, the collar section 341 of the washer 34 is slightly smaller than the inner diameter of the sleeve 112. Therefore, when the screw 33 is fitted with the washer 34 and screwed into the hole 324 of the fixing rod 32, the collar section 341 is fitted into the sleeve 112 of the through hole 111 to locate the washer 34 and the screw 33.

According to the above arrangement, the tail wing of the model airplane can be quickly firmly assembled or disassembled from the airplane body for easy carriage or storage.

The above embodiment is only used to illustrate the present invention, not intended to limit the scope thereof. Many modifications of the above embodiment can be made without departing from the spirit of the present invention.

What is claimed is:

1. An assembly structure for a tail wing of a model airplane, comprising:

an airplane body having a tail section with a horizontal connecting face for connecting with a horizontal tail wing and a vertical tail fin, said vertical tail fin having a bottom face formed with a pair of rectangular sockets formed therein;

first and second fixing rods each having a rectangular section respectively inserted in said pair of rectangular sockets, said rectangular section of each said fixing rod being disposed at an upper section thereof, a lower section of each of said fixing rods being formed with a cylindrical section and a bottom end of each of said fixing rods being formed with an axial hole;

a pair of screws each fitted with a washer, each said screw being engaged in an axial hole of a respective fixing rod, said horizontal tail wing having a center portion formed with first and second through holes corresponding to said first and second fixing rods of said vertical tail fin;

a first pair of sleeves respectively mounted in said first and second through holes, said horizontal connecting face of said tail section being formed with a pair of connecting through holes respectively corresponding to said first and second fixing rods installed in said vertical tail fin; and, a second pair of sleeves respectively mounted in said connecting through holes.

2. The assembly structure as recited in claim 1, wherein each said rectangular section of said first and second fixing rods being formed with multiple annular grooves.

3. The assembly structure as recited in claim 1, wherein each said washer has an axial collar section having an outer diameter smaller than an inner diameter of a respective one of said second pair of sleeves fitted in said connecting through hole.

* * * * *